US011002094B2

(12) United States Patent
Feng et al.

(10) Patent No.: US 11,002,094 B2
(45) Date of Patent: May 11, 2021

(54) THREE-DIMENSIONAL HYDRAULIC OSCILLATOR

(71) Applicant: Yangtze University, Jingzhou (CN)

(72) Inventors: Ding Feng, Jingzhou (CN); Peng Wang, Jingzhou (CN); Yu Zhao, Jingzhou (CN); Zhe Wang, Jingzhou (CN); Yi-Liu Tu, Jingzhou (CN)

(73) Assignee: YANGTZE UNIVERSITY, Jingzhou (CN)

( * ) Notice: Subject to any disclaimer, the term of this patent is extended or adjusted under 35 U.S.C. 154(b) by 122 days.

(21) Appl. No.: 16/517,427

(22) Filed: Jul. 19, 2019

(65) Prior Publication Data

US 2020/0048975 A1 Feb. 13, 2020

(30) Foreign Application Priority Data

Aug. 7, 2018 (CN) ..... 201810892464.6

(51) Int. Cl.

| | |
|---|---|
| ***E21B 28/00*** | (2006.01) |
| ***E21B 7/24*** | (2006.01) |
| ***B06B 1/18*** | (2006.01) |
| ***E21B 7/124*** | (2006.01) |

(52) U.S. Cl.

CPC ..... *E21B 28/00* (2013.01); *B06B 1/18* (2013.01); *E21B 7/124* (2013.01)

(58) Field of Classification Search

CPC ..... E21B 28/00; E21B 7/24

See application file for complete search history.

(56) References Cited

U.S. PATENT DOCUMENTS

| | | | | |
|---|---|---|---|---|
| 10,267,109 | B2 * | 4/2019 | Solem | E21B 7/24 |
| 2012/0048619 | A1 * | 3/2012 | Seutter | E21B 47/24 175/27 |
| 2016/0130898 | A1 * | 5/2016 | Solem | E21B 28/00 166/177.6 |
| 2020/0056437 | A1 * | 2/2020 | Matthews | E21B 23/02 |

* cited by examiner

*Primary Examiner* — Catherine Loikith

(74) *Attorney, Agent, or Firm* — Hemisphere Law, PLLC; Zhigang Ma

(57) ABSTRACT

A three-dimensional hydraulic oscillator includes an upper casing, a lower casing screwed with the upper casing, an upper joint screwed with the upper casing, a lower joint screwed with the lower casing and a screw. An upper rotating shaft is mounted in the upper casing. A turbine group is mounted on the upper rotating shaft. An upper cam is fixed to the upper rotating shaft. A lower cam is movably mounted in the upper casing. The upper cam contacts with the lower cam. The screw is mounted in the upper casing and fixed to the lower cam. A lower rotating shaft is mounted in the lower casing. An eccentric block is fixed on the lower rotating shaft. A lower roulette is fixed to the lower rotating shaft. A shaft cap is disposed above the lower roulette. An upper roulette is mounted on the screw and meshed with the lower roulette.

7 Claims, 6 Drawing Sheets

THREE-DIMENSIONAL HYDRAULIC OSCILLATOR

FIELD

The subject matter herein generally relates to hydraulic oscillators, specially relates to a three-dimensional hydraulic oscillator.

BACKGROUND

Because horizontal wells, horizontal branch wells, and large displacement wells can help oil fields to increase production, they have been increasingly applied to drilling in major oil fields in recent years. In such wells, there is a large frictional resistance after a pipe string is in contact with a wall of the well. When the frictional resistance is too large, the pipe string will undergo sinusoidal bending or spiral buckling, which will seriously cause stuck drilling, affect a drilling speed and reduce drilling efficiency.

In conventional drilling, drilling tools are in a static friction state with the wall of the well. Whether it is a vertical well, a directional well or a horizontal well, the friction between the pipe string and the wall of the well during drilling is an important factor affecting the drilling speed. An oscillator generates axial and radial forces to form an oscillating effect. The friction between the pipe string and the wall of the well is converted from static friction to dynamic friction to achieve the purpose of reducing friction. However, in a horizontal section or an inclined section during the drilling, the friction between the pipe string and the wall of well is still large.

Therefore, there is room for improvement within the art.

BRIEF DESCRIPTION OF THE DRAWINGS

Implementations of the present technology will now be described, by way of embodiments with reference to the attached figures.

DETAILED DESCRIPTION

Figure 1:
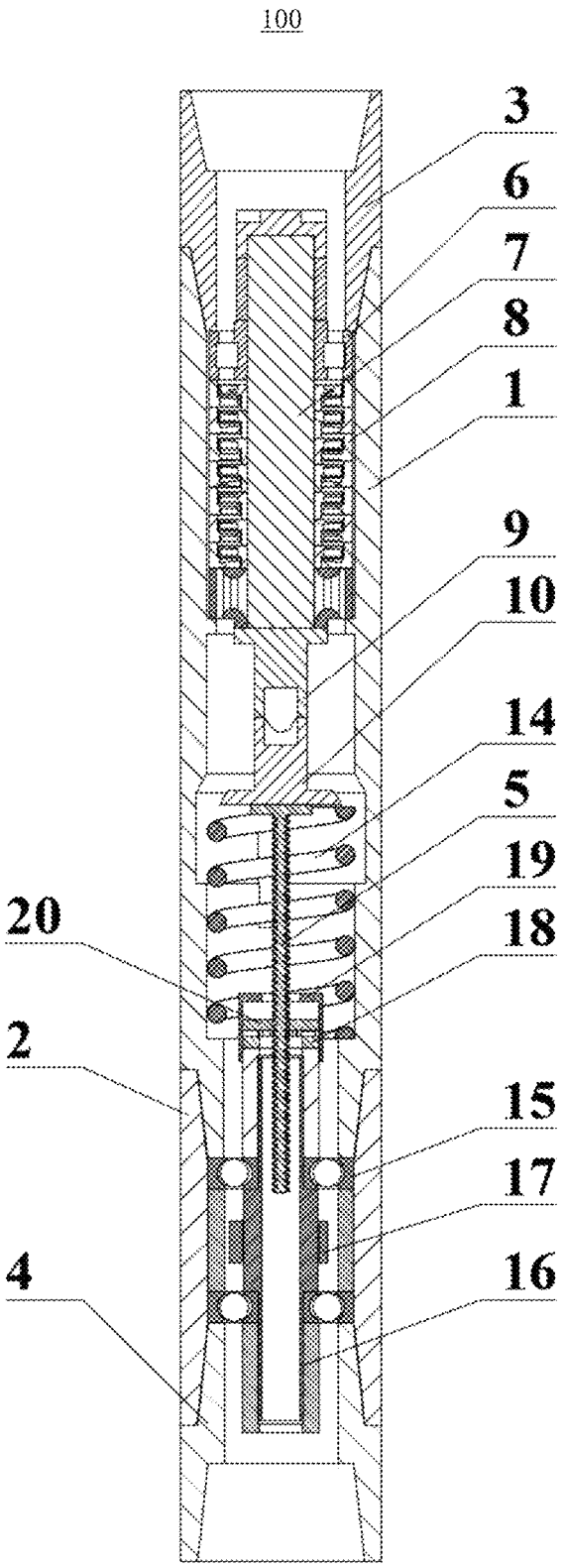
FIG. 1 is a schematic view of a three-dimensional hydraulic oscillator.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to show details and features of the present disclosure better. The disclosure is by way of embodiments and not by way of limitation in the figures of the accompanying drawings, in which like references indicate similar elements. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including but not necessarily limited to"; it specifically indicates open-ended inclusion or membership in the so-described combination, group, series, and the like. The references "a plurality of" and "a number of" mean "at least two."

Figure 2:
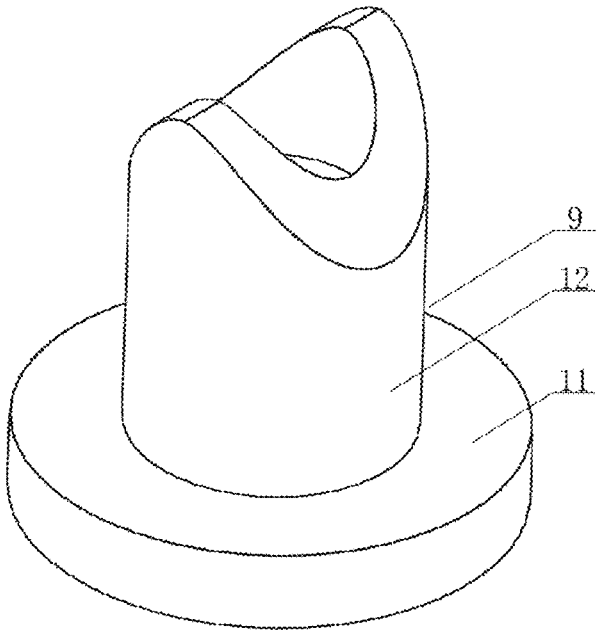
FIG. 2 is an isometric view of an upper cam in FIG. 1.
Figure 3:
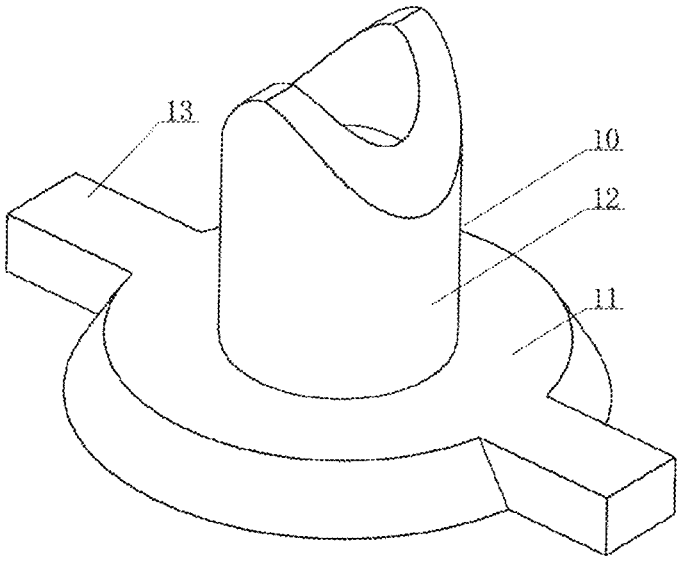
FIG. 3 is an isometric view of a lower cam in FIG. 1.
Figure 4:
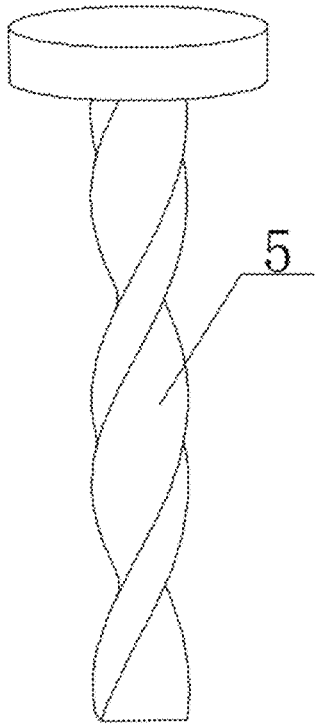
FIG. 4 is an isometric view of a screw in FIG. 1.
Figure 5:
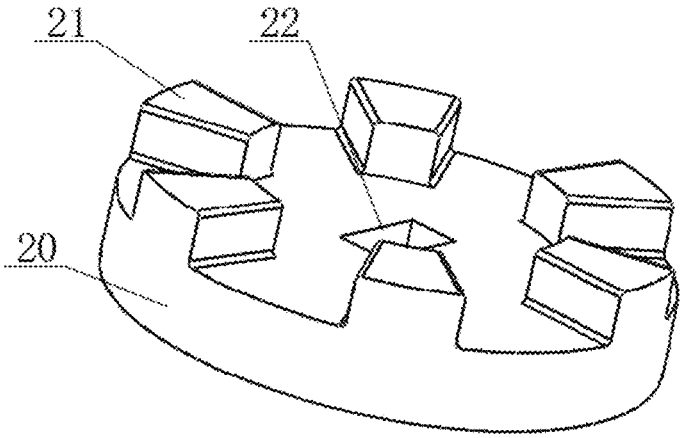
FIG. 5 is an isometric view of an upper roulette in FIG. 1.
Figure 6:
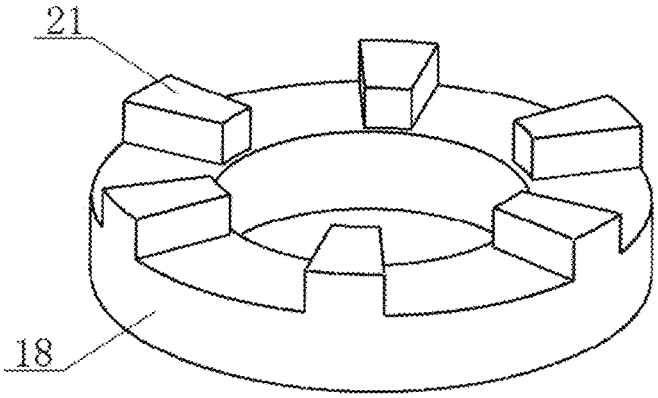
FIG. 6 is an isometric view of a lower roulette in FIG. 1.

FIGS. 1 to 6 illustrate a three-dimensional hydraulic oscillator 100 according to an embodiment of the present application. The three-dimensional hydraulic oscillator 100 includes an upper casing 1, a lower casing 2, an upper joint 3, a lower joint 4 and a screw 5. The upper casing 1 is screwed with the lower casing 2. A center hole of the upper casing 1 is a stepped hole. One end of the upper casing 1 is screwed with the upper joint 3. One end of the lower casing 2 is screwed with the lower joint 4. An upper rotating shaft 7 is mounted in the upper casing 1 by symmetrically disposed of central bearings 6. A turbine group 8 is mounted on the upper rotating shaft 7 between the centralizing bearings 6. The turbine group 8 includes a rotor and a stator. An upper cam 9 is fixed to a lower end of the upper rotating shaft 7. A lower cam 10 is movably mounted in the upper casing 1 below the upper cam 9. The upper cam 9 and the lower cam 10 are respectively T-shaped. The upper cam 9 and the lower cam 10 are respectively constituted by the cam disc 11 and the cam rod 12. The cam rod 12 is fixed at the center position of the cam disc 11. The cam rod 12 is a hollow body. A top of the cam rod 12 is tapered.

Restricting rods 13 are symmetrically disposed on the cam disc 11 of the lower cam 10. An inner wall of the upper casing 1 corresponding to the lower cam 10 defines sliding grooves. The lower cam 10 is slidably coupled to the upper housing 1 by the restricting rod 13 received in the sliding groove. The upper cam 9 is sliding contact with the lower cam 10.

The screw 5 is mounted in the upper casing 1 below the lower cam 10 through a spring 14. The screw 5 is a T-shaped. The screw 5 is fixedly connected to the lower cam 10. The upper rotating shaft 7 drives the upper cam 9 to rotate during operation. Because the cam 10 cannot rotate circumferentially due to a limit of the restriction rod 13, it can only move axially. During a cycle of the upper cam 9, the lower cam 10 is pressed by a tapered slope of the top of the cam rod 12 to move axially downward. When the upper cam 9 and the tapered top of the lower cam 10 are in contact, the lower cam 10 is axially lowered into a preset position. Then as the upper cam 9 continues to rotate, the tapered tops of the upper cam 9 and the lower cam 10 are gradually released, and at the same time, under an action of the spring 14, the lower cam 10 moves up to reset it. In this way, the lower cam 10 and the screw 5 reciprocate axially.

A lower rotating shaft 16 is mounted in the lower casing 2 below the spring 14 by symmetrically disposed bearings 15. The lower rotating shaft 16 is a hollow body. During operation, under the action of the bearing 15, the lower rotating shaft 16 can only rotate in the circumferential direction and cannot move axially. An eccentric block 17 is fixed on the lower rotating shaft 16 between the bearings 15. A lower roulette 18 is fixed to the top of the lower rotating shaft 16. A shaft cap 19 is disposed above the lower roulette 18, and the shaft cap 19 is screwed to the lower rotating shaft 16. Above the lower roulette 18, an upper roulette 20 is mounted on the screw 5 in the shaft cap 19. The upper roulette 20 and the lower roulette 18 are respectively in the shape of a disc. The upper roulette 20 and the lower roulette 18 are respectively provided with transmission teeth 21. The upper roulette 20 and the lower roulette 18 are intermittently meshed with each other by the engagement of the transmission teeth 21. The center of the upper roulette 20 defines a rectangular fitting hole 22. The upper roulette 20 is mounted on the screw 5 through the fitting hole 22.

The shaft cap 19 and the lower roulette 18 respectively defines a center hole for passing through the screw 5. One end of the screw 5 extends through the center holes of the shaft cap 19 and the lower roulette 18 into the lower rotating shaft 16.

When the three-dimensional hydrodynamic oscillator 100 is in operation, the drilling fluid entering from the upper joint 3 impacts the turbine group 8 to drive the upper rotating shaft 7 to rotate. The upper rotating shaft 7 drives the upper cam 9 to rotate. Because the upper cam 9 is in contact with the lower cam 10, during the rotation of the upper cam 9, the lower cam 10 is pressed, thereby driving the screw 5 to move up and down. When the screw 5 moves downward, the upper roulette 20 simultaneously moves downward with the screw 5. When the upper roulette 20 moves downward to meshes with the lower roulette 18, under the action of the resistance of the lower roulette 18, the upper roulette 20 is blocked from moving downward with the screw 5. At this time, the screw 5 continues to move downward, and since the upper reel 20 is blocked to move downward continuously, the downward force of the screw 5 can press the upper roulette 20 to drive the upper roulette 20 to rotate.

Since the upper roulette 20 and the lower roulette 18 are in mesh with each other; the upper roulette 20 rotates while the lower roulette 18 rotates, and the lower roulette 18 drives the lower rotating shaft 16 to rotate, thereby driving the eccentric block 17 to rotate. The eccentric block 17 rotates to generate the radial centrifugal force and the circumferential oscillating force. The oscillating force can reduce the friction of a drill during the rock breaking process and improve the drilling efficiency.

When the screw 5 is lowered into a determined position, it moves up by the action of the spring 14. The upper roulette 20 ascends with the screw 5 and disengages from the lower roulette 18. At this time, under the action of inertia, the lower rotating shaft 16 continues to rotate. When the tapered tops of the upper cam 9 and the lower cam 10 come into contact again, the screw 5 moves downward again, so that the upper roulette 20 and the lower roulette 18 are again engaged with each other. In this way, the lower rotating shaft 16 is continuously rotated.

The embodiments shown and described above are only examples. Therefore, many commonly-known features and details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will, therefore, be appreciated that the embodiments described above may be modified within the scope of the claims.

What is claimed is:

1. A three-dimensional hydraulic oscillator comprising:

an upper casing;

a lower casing screwed with the upper casing;

an upper joint screwed with an end of the upper casing;

a lower joint screwed with an end of the lower casing; and a screw;

wherein an upper rotating shaft is mounted in the upper casing by symmetrically disposed central bearings, a turbine group is mounted on the upper rotating shaft between the centralizing bearings, an upper cam is fixed to a lower end of the upper rotating shaft, a lower cam is movably mounted in the upper casing below the upper cam, the upper cam contacts with and connects to the lower cam, the screw is mounted in the upper casing below the lower cam through a spring, the screw is fixed to the lower cam, a lower rotating shaft is mounted in the lower casing below the spring by symmetrically disposed bearings, an eccentric block is fixed on the lower rotating shaft between the bearings, a lower roulette is fixed to the top of the lower rotating shaft, a shaft cap is disposed above the lower roulette, and the shaft cap is screwed to the lower rotating shaft, an end of the screw extends through the shaft cap and the lower roulette into the lower rotating shaft, above the lower roulette, an upper roulette is mounted on the screw in the shaft cap, the upper roulette, and the lower roulette are meshed with each other.

2. The three-dimensional hydraulic oscillator of claim 1, wherein the lower rotating shaft is a hollow body.

3. The three-dimensional hydraulic oscillator of claim 1, wherein the upper cam and the lower cam are respectively T-shaped, the upper cam and the lower cam are respectively constituted by a cam disc and a cam rod, the cam rod is fixed at the center position of the cam disc.

4. The three-dimensional hydraulic oscillator of claim 3, wherein the cam rod is a hollow body, a top of the cam rod is tapered.

5. The three-dimensional hydraulic oscillator of claim 1, wherein the upper roulette and the lower roulette are respectively in the shape of a disc, the upper roulette and the lower roulette are respectively provided with transmission teeth, the upper roulette and the lower roulette are intermittently meshed with each other by the engagement of the transmission teeth.

6. The three-dimensional hydraulic oscillator of claim 5, wherein a center of the upper roulette defines a rectangular fitting hole, the upper roulette is mounted on the screw through the fitting hole.

7. The three-dimensional hydraulic oscillator of claim 5, wherein the lower roulette defines a center hole for passing through the screw.

* * * * *